US010799412B1

(12) United States Patent
Termanini

(10) Patent No.: US 10,799,412 B1
(45) Date of Patent: Oct. 13, 2020

(54) SURGICAL TABLE FOR DIRECT ANTERIOR SURGICAL APPROACH OF THE HIP

(71) Applicant: Zafer Termanini, Port Saint Lucie, FL (US)

(72) Inventor: Zafer Termanini, Port Saint Lucie, FL (US)

( * ) Notice: Subject to any disclaimer, the term of this patent is extended or adjusted under 35 U.S.C. 154(b) by 0 days.

(21) Appl. No.: 16/748,810

(22) Filed: Jan. 22, 2020

Related U.S. Application Data

(63) Continuation-in-part of application No. 16/732,044, filed on Dec. 31, 2019.

(51) Int. Cl.
*A61G 13/08* (2006.01)
*A61G 13/00* (2006.01)
*A61G 13/12* (2006.01)

(52) U.S. Cl.
CPC ..... *A61G 13/0081* (2016.11); *A61G 13/08* (2013.01); *A61G 13/123* (2013.01); *A61G 13/125* (2013.01); *A61G 13/129* (2013.01); *A61G 13/1225* (2013.01); *A61G 13/1285* (2013.01); *A61G 2200/327* (2013.01); *A61G 2210/10* (2013.01)

(58) Field of Classification Search
CPC ..... A61G 13/08; A61G 13/12
USPC ..... 5/621, 624, 613–618
See application file for complete search history.

(56) References Cited

U.S. PATENT DOCUMENTS 5,645,079 A * 7/1997 Zahiri ..... A61F 5/3769 128/882
6,202,230 B1 * 3/2001 Borders ..... A61G 13/0009 5/613
6,622,324 B2 * 9/2003 VanSteenburg ..... A61G 13/04 128/845
2004/0133983 A1 * 7/2004 Newkirk ..... A61G 13/0036 5/624

* cited by examiner

*Primary Examiner* — Fredrick C Conley
(74) *Attorney, Agent, or Firm* — Samir Termanini, Esq.

(57) ABSTRACT

Surgical table for providing hyperextension of the hip joint during direct anterior approach without need for lowering the distal end of the operating table. The attachment will allow external rotation as well as adduction for better exposure of the proximal end of the femur. It further allow for motorized traction of the lower extremity controlled by the operating surgeon. The inventive device conveniently incorporates a femoral elevator mechanism that will raise the proximal end of the femoral bone for better visualization through the surgical wound and easier reaming of the femoral canal.

11 Claims, 6 Drawing Sheets

SURGICAL TABLE FOR DIRECT ANTERIOR SURGICAL APPROACH OF THE HIP

FIELD OF THE INVENTION

The present invention relates to a surgical table and more particularly to operating room table used to facilitate the visualization of the hip anatomy during direct anterior surgical approach to the hip.

DESCRIPTION OF THE PRIOR ART

Total hip replacement surgery has been one of the most common and successful surgical procedure in orthopedic surgery. Since its introduction by Carl Heuter in 1881 it has gained significant popularity. It was later popularized in Europe by Robert Judet and in the United States by Smith Peterson. The direct anterior approach to the hip has been suggested to have several advantages compared to previously popular approaches such as the posterior, lateral or anterolateral approaches. It preserves posterior structures that are important for preventing dislocation while preserving important muscles attachment to the greater trochanter. It is obvious that lack of disturbance of the minimus and medius muscle insertions facilitate the recovery and rapid return to normal gait. Furthermore, the lack of disturbance of the gluteus maximus and fascia lata is a further benefit of the anterior approach. In view of the tissue sparing and minimally invasive benefits, direct anterior total hip arthroplasty has gained popularity in recent years and has given rise to a sharp increase in its utilization. However, the procedure required using specially designed table as well as special instruments. Proper surgical technique and limb positioning are vital to reduce the risk of intraoperative complication, such as femoral bone fracture or damage to the surrounding soft tissue. This has caused the learning curve to be steep and slow. Specialty designed tables such as the Hannah table are extremely expensive and necessitate the help of extra personnel to manipulate the table and the operated extremity. These tables and their attachments are cumbersome and required large space for storage. One of the major disadvantages of these specialty tables and their attachments is that they require large space for the storage. In addition, in order to provide extension of the hip joint for exposing the proximal end of the femur, the operated leg is lowered down by a technician or circulating nurse, where the foot becomes very close to the floor thereby increasing chance of contamination of the sterile drapes and operative field. Another critical challenge during the surgical procedure is to raise the proximal end of the femoral bone so the medullary canal can be reamed. Retractors and bone hooks are usually used to elevate the femur, however any excessive traction may cause a femoral fracture, especially in thin osteoporotic bone. More elaborate femoral bone mechanical elevators attachment has been designed, such as the Wixson Anterior suspension Hook System. These are usually attached to the table but are cumbersome and may get in the way of the operating surgeon. Undue traction may also cause fracture of the femur. The present disclosure describes a surgical operating table, which provides a safe extension of the hip as well as a mechanism to raise the proximal end of the femoral bone without the use of bone traction hooks or other suspension devices.

The present disclosure describes a surgical operating table, which provides a safe extension of the hip as well as a mechanism to raise the proximal end of the femoral bone without the use of traction bone hooks or other suspension devices.

SUMMARY OF THE INVENTION

In view of the foregoing disadvantages inherent in the known type of surgical tables used for the anterior approach, and femoral bone traction and elevator devices now present in the prior art, the present invention provides a new surgical table and femoral bone elevator that can be easily used to perform hip replacement through a small incision using minimally invasive anterior surgical approach.

The general purpose of the present invention, which will be described subsequently in greater detail, is to provide a novel surgical operating table that has many advantages of the existing specialized surgical tables and many novel features that result in a new operating table which is not anticipated, rendered obvious, suggested, or even implied by any of the prior on either alone or in any combination thereof.

To attain this, the present invention generally comprises an upper folding platform having two segments. The proximal segment for the torso pelvic region. The distal segment is for the lower extremities. The junction between the two segments will be raised mechanically causing the torso pelvic platform and the distal segment to fold. The lifting mechanism of the torso pelvic platform comprises motor and rotary threaded worm gear. Said motor and gear are conspicuity located in the table hydraulic lift column and operated by the operating surgeon using foot pedal.

To attain this, the present invention generally comprises a torso pelvic platform attached to a distal lower extremity segment. The junction between the two segments is situated at the level of the hip joint. Said junction will be raised mechanically causing the torso pelvic platform to fold. A central post vertically situated in the middle of the folding portion and firmly attached to the center of the torso pelvic platform. Said central post provide stability and prevent the patient from sliding distally when traction is applied distally to the operated leg.

The lifting mechanism of the torso pelvic platform comprises a motor and rotary threaded worm gear. Said motor and gear are located in the table lift column and operated by foot pedal. It is to be understood that when the motor turn it will turn the rotary threaded worm gear, which will raise a lifting rod and subsequently folding the torso pelvic platform.

Furthermore, the lower extremity segment comprises attachment for supporting the foot on the operated side. Said attachment will provide a mechanism for traction as well as internal or external rotation of the foot attachment. These movements are essential steps for the anterior surgical approach to the hip. The traction is provided by a worm gear attached to a motor situated within the extension tube between the lower extremity platform and the foot attachment. The traction motor has its own rechargeable power supply conveniently located in the extension tube. The operating surgeon also controls it by using a switch for in/out traction located on the proximal extension tube and easily palpated by the surgeon without the need for additional personnel to manipulate the foot attachment. The control of said motor can be accomplished by foot pedal. The lower foot attachment also allows for adduction or abduction of the operated leg thus providing improved exposure of the proximal femur through the small surgical incision.

After the removal of the femoral head, the proximal end of the femoral bone is now located deep in the surgical wound and reaming of the femur becomes quite difficult due to poor exposure of the femoral canal. It is therefore significantly advantageous to raise the proximal end of femur and elevate it through the wound and make it more accessible to. Once the neck of the femur is cut and osteotomized, its proximal end becomes mobile since the anterior capsule has already been released and detached. The femur can be further mobilized by release of the piriformis and obturator internus tendon. Upward pressure on the posterior surface of the thigh will force the femur to rise up and its proximal end to protrude through the surgical wound and subsequently it becomes more accessible for reaming the femoral canal. Therefore the use of hooks and lifting devices to lift the proximal end of the femur become unnecessary since these devices may lead to undue stress on the femoral bone causing complications such as fractures.

It is the advantage of this invention to provide a lifting mechanism for femoral bone uplifting after the femoral head is removed. To accomplish this, a femoral elevator plate is provided in the thigh rest, which is moved upward proximally using a sliding motorized wedge.

There has thus been outlined, rather broadly, the more important features of the invention in order that the detailed description thereof may be better understood and in order that the present contribution to the art may be better appreciated. There are additional features of the invention that would be described hereinafter.

In this respect, before explaining that preferred embodiment of the present invention in detail, it is to be understood that the invention is not limited in its application through the details of construction and arrangement of its components set forth in the following description or illustration. Also, it is to be understood that Internet phraseology was employed here in for the purpose of the description and should not be regarded as limiting.

A primary object of the present invention is to provide a surgical table attachment that will overcome the shortcomings of the prior art devices. Said innovative surgical table would be capable of facilitating the surgical approach to the proximal end of the femoral bone after the removal of the femoral head.

Other objects and advantages of the present invention will become obvious to the reader and it is intended that these objects and advantages be within the scope of the present invention.

To the accomplishment of the above and related objects, this invention may be embodied in the form elicited in the accompanying drawings, attention being called to the fact, however, that the drawings are illustrative only and that changes may be made in the specific construction illustrated.

BRIEF DESCRIPTION OF THE DRAWINGS

The present invention can be easily understood by creating that subsequent detailed description of the preferred embodiment thereof with references made to the accompanying drawings, wherein.

DETAILED DESCRIPTION OF THE INVENTION

Turning now descriptively to the drawings, in which similar references characters denote similar elements throughout the several views, the attached figures illustrate the operative table and its innovative components.

Figure 1:
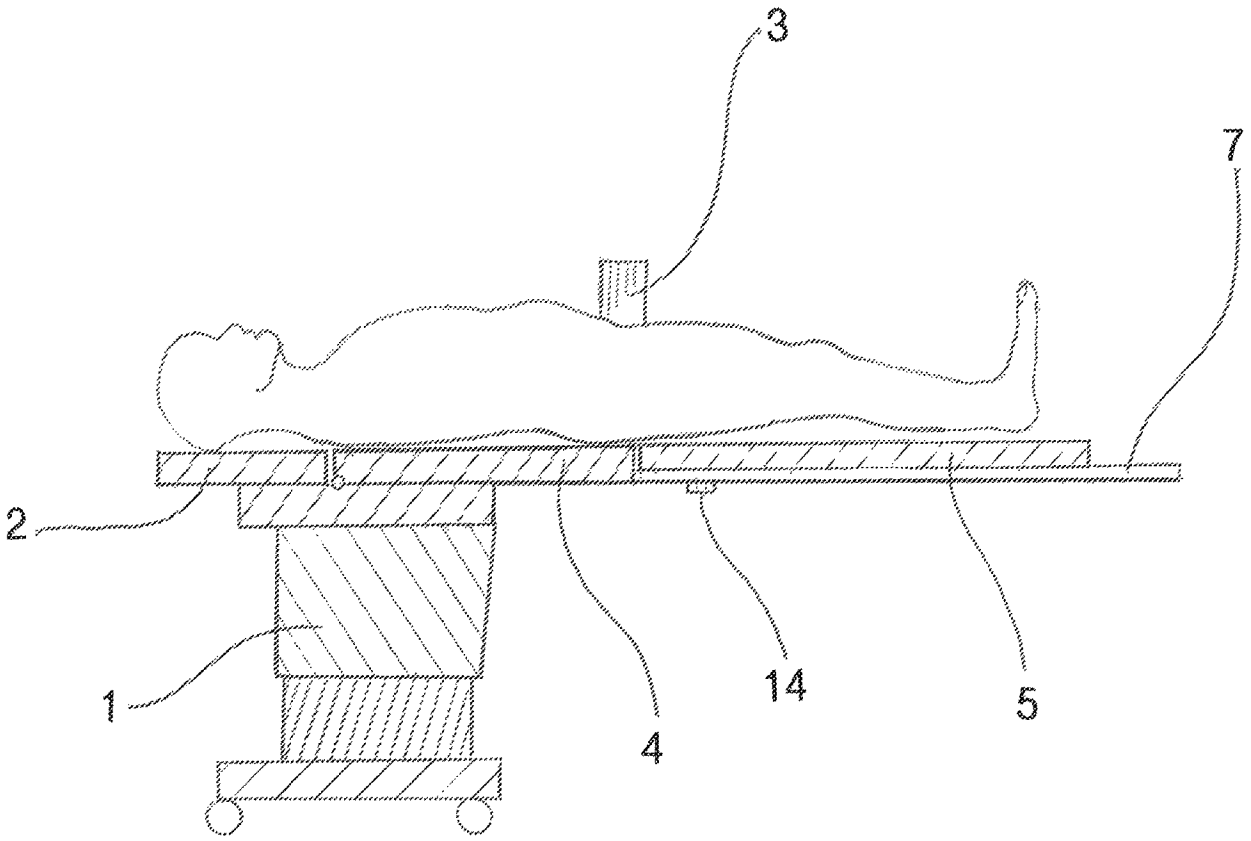
FIG. 1 is a side view of operating table and attachment in flat position.

Referring to FIG. 1, the patient is placed in supine position over the operating table with his body resting over the torso pelvic platform 4. Conventional Hydraulic unit 1 allows raising or lowering the operating table to the appropriate height. The patient lower extremity foam cushion 5 is placed under lower extremity and over the lower end of the table 7. The central post 3 is inserted between the lower extremities to stabilize the pelvis and prevent him from sliding off the table when traction is applied to the lower extremity. The patient's head is placed over the headrest 2.

Figure 2:
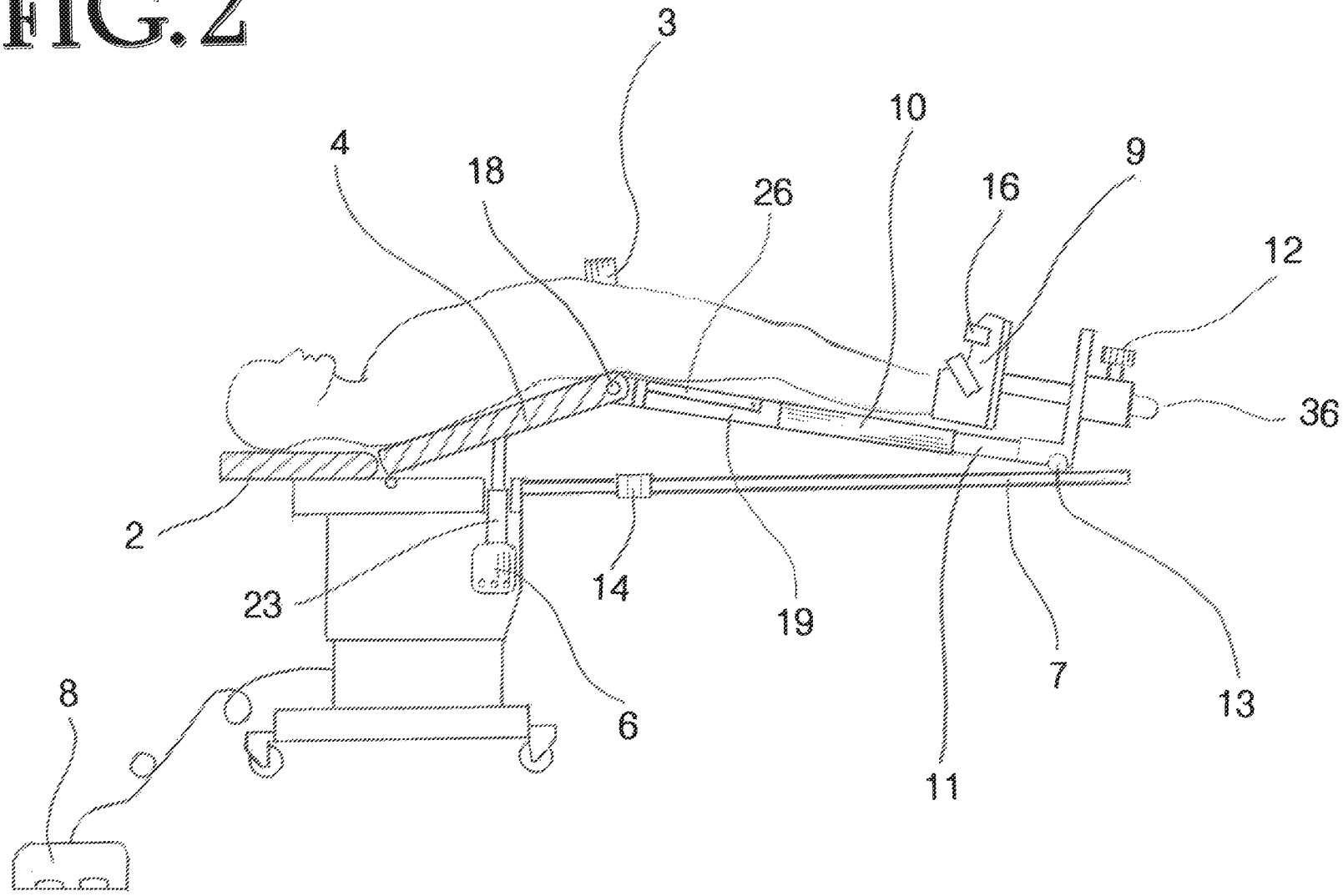
FIG. 2 is a side view of operating table and attachment in flexed position with lower extremity strut attached.

Now referring to FIG. 2, where the flexing mechanism is activated via motor 6 which raises the pelvic bone of the patient causing the proximal torso pelvic platform 4 and distal lower extremity plate 19 to flex. This will cause the patient supporting structures to flex at the level of the locking bolt 18. The lower extremity on the operated side is then supported by the lower extremity plate having a extension in a form of proximal tubular strut 10, which rests over the lower extremity rest 7. Said strut having a foot boot 9 for holding the foot and situated at the end of the lower extremity strut. The foot is then secured with Velcro straps 16. In another embodiment, the foot may be secured using conventional ski boot buckles. Foot boot 9 is attached to vertical end plate 44 via shaft 36 (See FIG. 4). The vertical end plate 44 is firmly attached to the distal tubular strut 11. It is to be noted that said boot attachment and can be rotated clockwise and counterclockwise then locked in position using locking knob 12. Furthermore, the lower extremity thigh platform 19 and the tubular extensions 10 and 11 are capable of abduction (Right) and adduction (left) around pivot 25. The lower extremity attachment is interchangeable between right and left operated hip.

Figure 3:
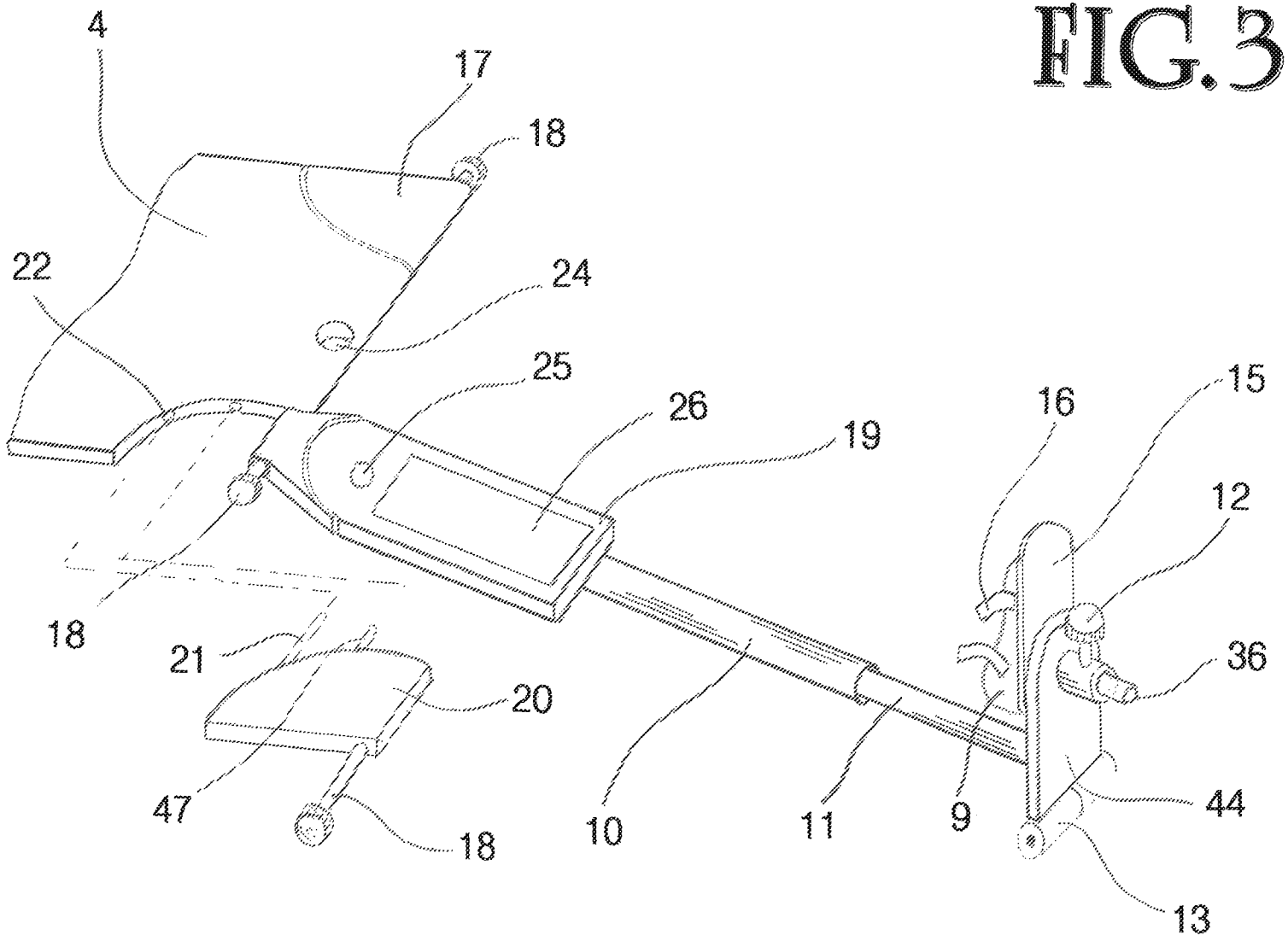
FIG. 3 is a perspective view of the lower extremity attachment strut.

FIG. 3, illustrates a lower extremity extension strut and foot attachment comprising torso pelvic platform 4 having corner extensions 17 and 20, conveniently removable on either side prior to surgery for improved X-rays transparency. The removable corner extensions are securely attached to the torso pelvic platform 4 by two stabilizing pins 21 and 47 and locking bolt 18. The torso plate 4 is elevated by the lifting motor 6 (FIG. 2), which will place the operated hip joint in extension. The torso pelvic platform provides a circular hole 24 for receiving the central post 3 (FIG. 2, 3). The lower extremity unit comprises a proximal tubular strut 10 firmly attached to thigh platform 19. A distal extension tubular strut 11 slidably located into the proximal tubular strut 10. Furthermore, foot-restraining attachment is attached to the end of the distal extension tubular strut 11. The later comprises a boot 9 with Velcro fasteners or ski boot buckles 16 attached to a vertical sole plate 15 having a shaft 36 going through a tube and a locking knob 12. The later allows the boot to rotate in clockwise or counterclockwise position. A cylinder wheel 13 allows the foot extension unit to slide onto the foldable lower extremity rest 7.

Figure 4:
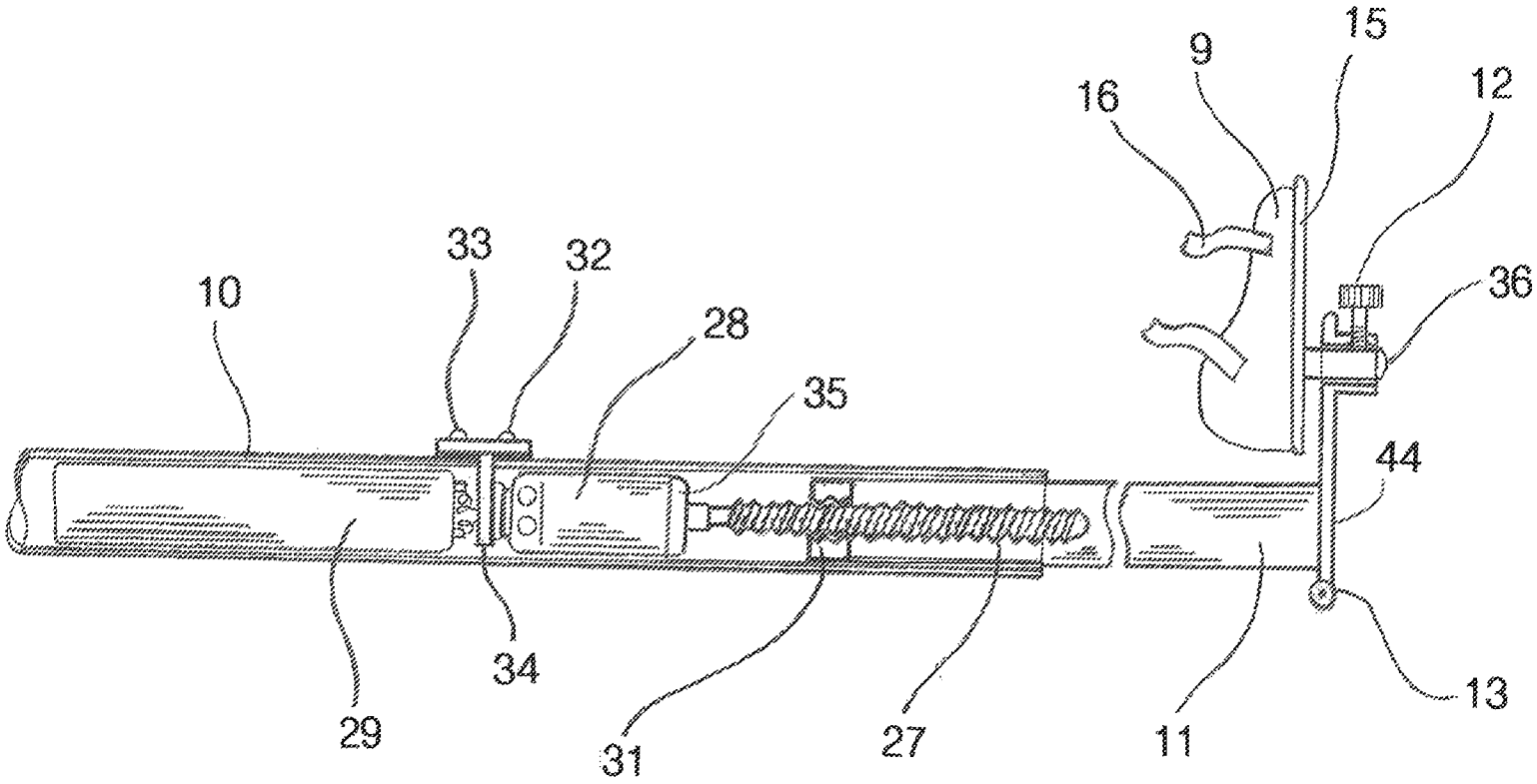
FIG. 4 is a side view of the lower extremity tubular strut.

Referring now to FIG. 4, which depicts the traction mechanism situated in the proximal tubular strut 10, comprising motor 28 with gearbox 35 and screw worm gear having threaded shaft 27. A threaded plate 31 firmly attached inside the proximal end of extension tubular strut 11, which is slidably situated in proximal tubular strut 10. The threaded shaft 27 rotates through the center of the threaded plate 31 causing the extension tubular strut 11 to slide forward or backward depending on the direction of rotation of threaded shaft 27. Furthermore, the distal end of the extension tube strut 11 provides an attachment to secure the foot. Said attachment comprises a vertical plate 44 firmly attached to the end of extension tube strut 11 and boot 9 having restraining Velcro straps or ski buckles 16. The sole of the boot 15 having a shaft 36 running into a tubular member allowing the boot to rotate right or left. Knob 12 locks the rotation into position.

Figure 5:
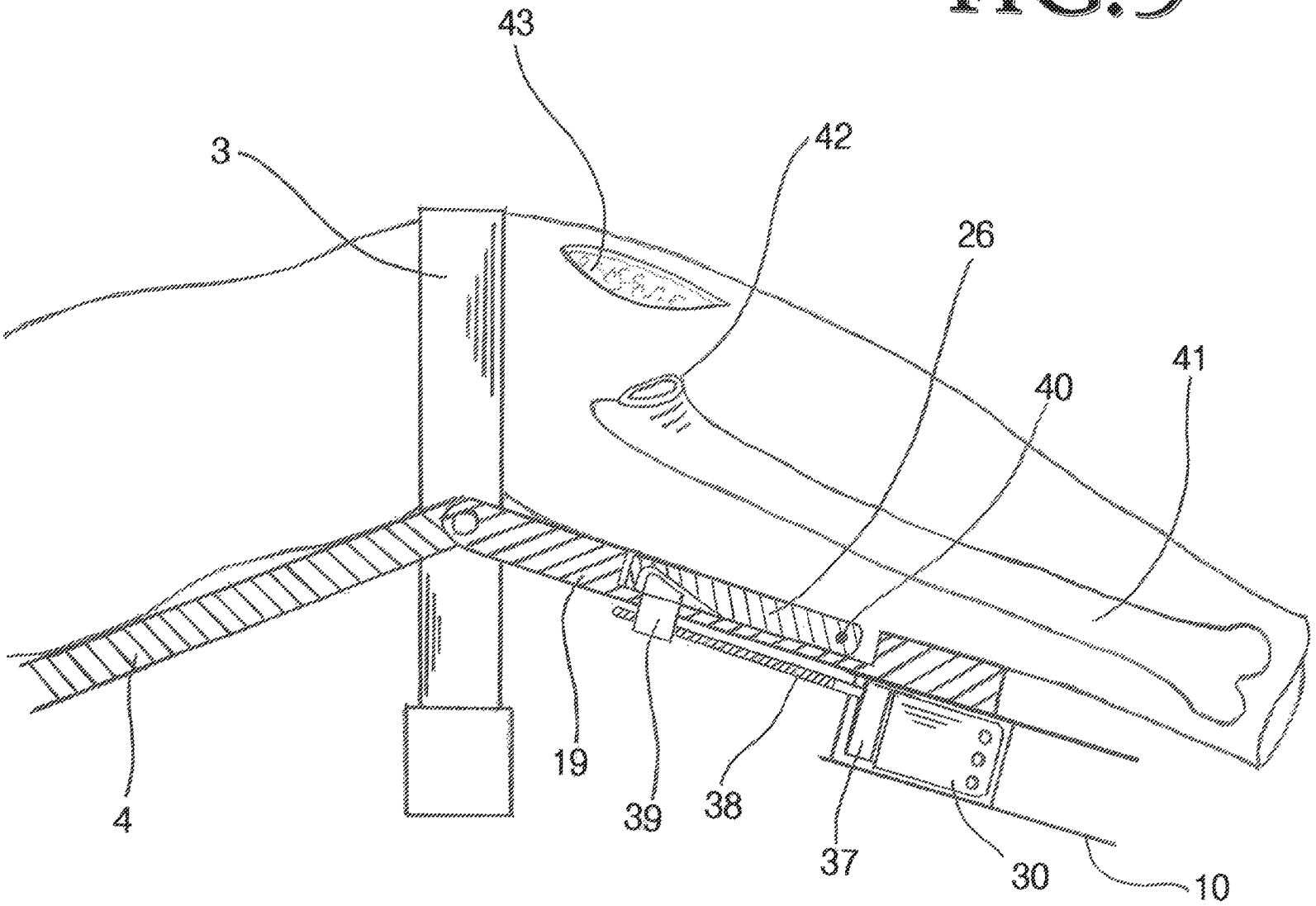
FIG. 5 is a side view of the lower extremity thigh rest and tubular strut with the femoral elevator in the down position.

FIG. 5, illustrates the mechanism of femoral bone elevator plate 26 movement. Motor 30 is located inside the proximal end of proximal tubular strut 10 and its gear box 37 and screw worm gear 38 which will mechanize the lifting wedge 39. As the latter is pulled distally by the motor it will slide under the femoral elevator plate 26 causing its proximal end to raise and elevate the femoral bone so its proximal end 42 will protrude through the surgical incision 43.

Figure 6:
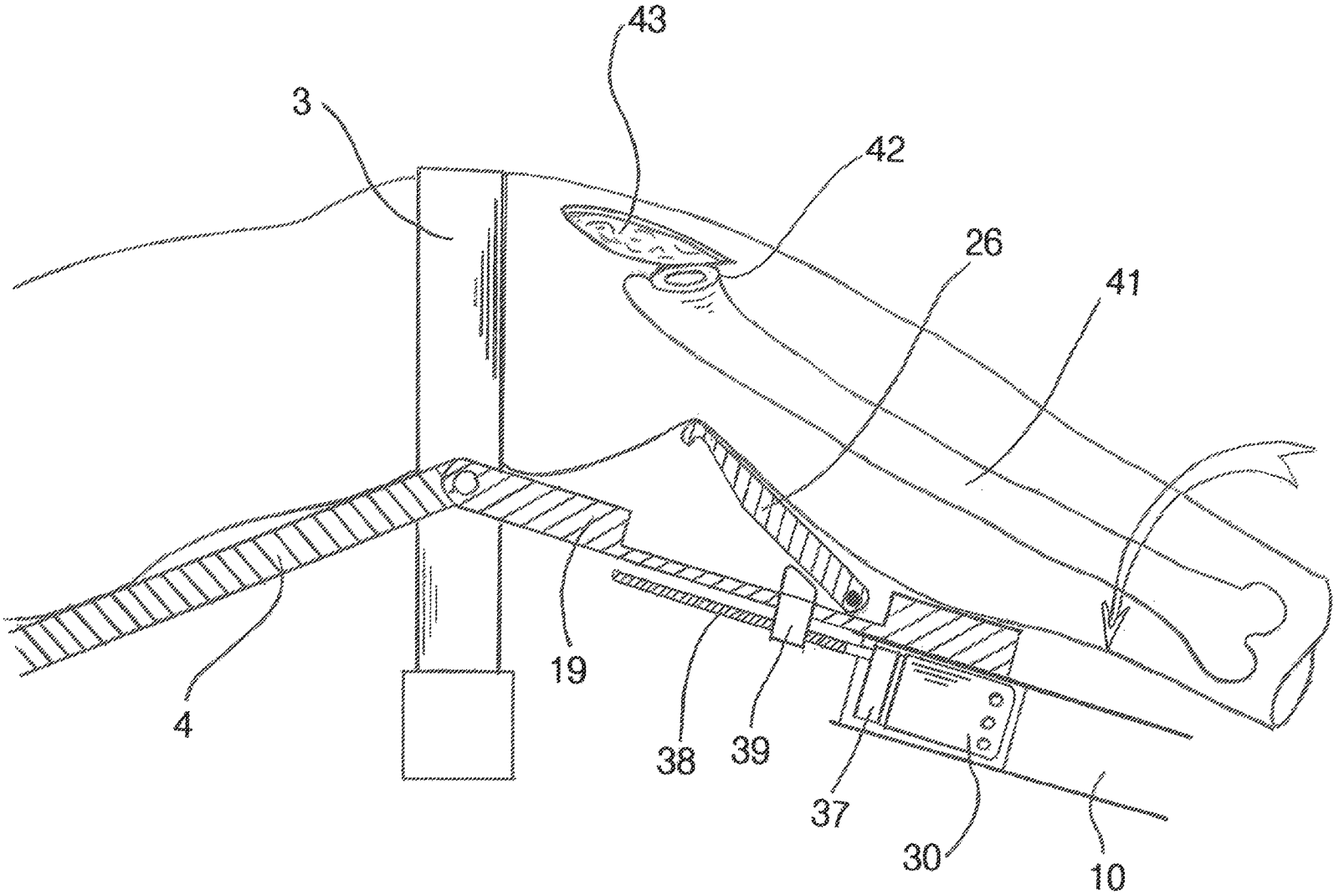
FIG. 6 is a side view of the lower extremity thigh rest and strut with femoral elevator up.

Referring now to FIG. 6, depicts a side sectional view of the femoral elevator mechanism.

The distal movement of the lifting wedge 39 will slide under the femoral plate 26 causing it to rise and push up the femoral bone 41 and its proximal end 42 closer to the skin incision 43. When the operation is complete, reversing the Motor 92 will move the sliding wedge 39 proximally causing the femoral elevator to come down and becomes flat and level with the thigh plate 19. Furthermore, FIG. 6 clearly shows the external rotation of the femur which will improve alignment of the cut femur vis a vis the surgical incision, which will facilitate reaming of the femoral medullary canal.

The surgical table components as described maybe constructed from like metallic alloy, plastic, or composite material. For example, it may be constructed of radiolucent material, allowing intra operative X-ray control.

It is to be understood that the above-described arrangements are only illustrative of the application of the principles of the disclosure. Those skilled in the art may devise numerous modifications and alternative arrangements without departing from the spirit and scope of the disclosure and the claims are intended to cover such modifications and arrangements. Thus, while the disclosure has been shown in the drawings and described above with particularity and detail, it will be apparent to those of ordinary skill in the art that numerous modifications, including but not limited to, variations in size, materials, shape, form, function and manner of operation, Assembly and use may be made without departing from the principles and concepts set forth herein.

It should be understood that this description is not intended to limit the embodiments. Although the invention has been described in connection with a preferred embodiment, it should be understood that various modifications, additions and alterations may be made to the invention by one skilled in the art without departing from the spirit and scope of the invention as defined in the appended claims The above-described embodiments are intended to be it illustrative in all aspects, rather than restrictive, all the embodiments. Thus, the embodiments are capable of many variations in detailed implementation that can be derived from the description contained herein by a person skilled in the art. No element, act, or instruction used in the description of the present application should be construed as critical or essential to the embodiments unless explicitly described as such.

Alternate embodiments maybe devised without departing from the spirit or the scope of the different aspects of the embodiments.

What is claimed:

1. A surgical operating table comprising:
- a torso pelvic platform;
- a thigh platform;
- a foot strut attachment;
- a motorized flexing mechanism; and
- a femoral bone lifting device,
- wherein said foot strut attachment is firmly attached to the bottom of the thigh platform and consists of a rigid proximal tubular strut having a distal extension tubular strut slidable inside the proximal tubular strut.

2. The surgical operating table of claim 1, wherein the distal end of said distal extension tubular strut includes a foot restraining attachment comprising:
- a flexible boot having Velcro straps, secured to a vertical sole plate, said vertical sole plate having a shaft and a pivot joint to allow rotation to the right or the left; and
- a knob for locking the shaft thereby securing said flexible boot the desired position.

3. The surgical operating table of claim 1, wherein said proximal tubular strut further comprises a traction/distraction mechanism comprising:
- a threaded plate secured within said distal tubular extension;
- a motor conveniently situated inside proximal tubular strut; and
- a screw worm gear secured to said motor for moving said threaded plate distally or proximally when said motor is activated to turn clockwise counterclockwise, thereby causing the distal tubular extension to telescopically slide within said proximal tubular strut.

4. The surgical operating table of claim 1, wherein said thigh platform provides a central longitudinal section which is hinged distally so that it can be raised proximally providing pressure on the posterior surface of the thigh and pushing the femoral bone up where the proximal end will be brought up closer to the surgical wound.

5. The surgical operating table of claim 1, wherein said torso pelvic supporting platform further comprises:
- torso pelvic platform;
- a right removable corner extension for supporting the right hip;
- a left removable corner extension for supporting the left hip, wherein said removable corner extensions are secured to said torso pelvic platform with stabilizing rods and locking bolts.

6. The surgical operating table of claim 5, wherein said torso pelvic supporting platform is connected to the thigh platform via a removable hinge.

7. The surgical operating table of claim 6, wherein the lower extremity thigh platform is situated distal to said hinge to provide support for the thigh.

8. The surgical operating table of claim 5, wherein said torso pelvic supporting plate comprises a central hole for accepting a central pelvic post.

9. A surgical operating table comprising:—
- a torso pelvic platform;
- a thigh platform;
- a foot strut attachment;
- a motorized flexing mechanism; and
- a femoral bone lifting device, wherein said motorized flexing mechanism further comprises: a motor situated in the main table hydraulic lift column and attached to a screw worm gear, which will travel up and down as it turns clockwise or counterclockwise.

10. A surgical operating table comprising:

a torso pelvic platform;

a thigh platform;

a foot strut attachment;

a motorized flexing mechanism;

a femoral bone lifting device;

a femoral elevator plate situated in said thigh platform;

a sliding wedge having a slopped upper surface in contact with the lower surface of said femoral elevator plate;

a screw worm gear conveniently located within a proximal tubular strut to move said sliding wedge distally; and a motor located within said proximal tubular strut for driving said screw worm gear thereby for causing said sliding wedge to lift the elevator plate upward proximally and push the femur upward.

11. The surgical operating table of claim 10, further comprising a foot pedal connected to said motor for control by the operating surgeon.

* * * * *